United States Patent [19]

Degooyer

[11] Patent Number: 5,022,430

[45] Date of Patent: Jun. 11, 1991

[54] DRAINAGE DISK FOR PROTECTING WEEP CHANNELS OF MASONRY FLOOR DRAIN CONSTRUCTION

[76] Inventor: Lonnie C. Degooyer, 349 E. 5600 South, Murray, Utah 84107

[21] Appl. No.: 462,574

[22] Filed: Jan. 9, 1990

[51] Int. Cl.[5] ..... F16L 5/00

[52] U.S. Cl. ..... 137/362; 4/613; 285/158

[58] Field of Search ..... 137/362; 4/191, 613, 4/612; 285/158

[56] References Cited

U.S. PATENT DOCUMENTS

| | | | |
|---|---|---|---|
| 1,123,705 | 1/1915 | Dehn | 285/158 |
| 1,792,345 | 2/1931 | Williams | 137/362 |
| 2,025,814 | 12/1935 | Goss | 4/613 |
| 2,449,323 | 9/1948 | Richterkessing | 4/613 |
| 2,484,240 | 10/1949 | Monthland | 4/613 |
| 2,749,999 | 6/1956 | Schmid | 285/158 |
| 2,757,385 | 8/1956 | Whittick | 4/613 |
| 4,562,602 | 1/1986 | Cuschera | 285/159 |

FOREIGN PATENT DOCUMENTS

| | | | |
|---|---|---|---|
| 224606 | 3/1943 | Fed. Rep. of Germany | 4/613 |
| 1035381 | 4/1953 | France | 4/613 |

*Primary Examiner*—A. Michael Chambers

*Attorney, Agent, or Firm*—Terry M. Crellin

[57] ABSTRACT

A drainage disk is disclosed for placement around a drain opening in a floor of the type comprising a mortar layer, and a novel drain construction is provided wherein the drainage disk is positioned between the floor pan and the mortar which is laid over the floor pan. The drainage disk comprises a disk-shaped piece of relatively thin sheet material having a central opening therein. A plurality of elongate valleys are formed in the disk, with the valleys extending radially outwardly from the central opening in the disk piece. In the drain construction, the disk overlies the flange portion of the drain receptor to prevent the weep channels in the drain receptor from becoming clogged or blocked with extraneous matter. The valleys in the disk provide drainage from the pan to the weep channels in the drain receptor.

7 Claims, 2 Drawing Sheets

DRAINAGE DISK FOR PROTECTING WEEP CHANNELS OF MASONRY FLOOR DRAIN CONSTRUCTION

BACKGROUND OF THE INVENTION

1. Field of the Invention

The present invention relates to an improved weep hole protector for use in installing a floor of the type comprising a mortar layer around a floor drain. In particular, the invention relates to, novel, disk-shaped pieces of planar material which are readily positioned in the drain assembly of a tile floor for protecting the weep channels of the drain assembly from becoming blocked or clogged with foreign matter.

2. State of the Art

Building codes pertaining to masonry floors which have drains associated therewith, such as a floor of a shower stall, generally specify that a pan be placed on the subfloor, with mortar and tile being laid over the pan. The purpose of the pan is to direct any water seeping by the tile to the drain rather than into the sub-floor beneath the tile. To accomplish its purpose, the pan must slope to a drain, and means must be provided for conveying water seepage from the pan to the drain. The means advantageously comprises a drain assembly at the drain opening in the sub-floor. The drain assembly itself comprises a drain receptor at the drain opening in the sub-floor. The drain receptor has a flange which encircles the drain opening in the sub-floor. The drain receptor is connected to a drain, waste, vent system below the sub-floor. The opening in the pan overlies and is sealed water tight to the flange of the drain receptor. Weep channels are provided in the receptor for conveying water seepage from the pan to the drain, waste, vent system. To be effective, these weep channels must be kept open for flow of the water seepage therethrough. If mortar or other material blocks the weep channels then water seepage gets trapped between the tile and the pan.

The general practice is for the mason to slope the pan toward the drain and place a layer of gravel or other relatively course aggregate around the weep holes of the drain receptor. The practice is time consuming, and in many installations, especially those done by do-it-yourself masons, the placement of the gravel or aggregate is dispensed with entirely.

3. Objective

The principal objective of the present invention is to provide an inexpensive drainage disk which is quickly and easily placed around the drain opening and between the floor pan and the tile which is laid over the floor pan during the construction of the tile floor. The drainage disk provides superior protection for the weep channels in the drain receptor against becoming blocked or clogged with unwanted, extraneous material. In addition, the drainage disk provides flow channels for seepage water to flow from the pan to the weep channels in the drain receptor.

BRIEF DESCRIPTION OF THE INVENTION

The above objective is achieved in accordance with the present invention by providing a novel, inexpensive drainage disk for use in installing a floor of the type comprising a mortar layer around a floor drain. The drainage disk is particularly adapted for placement around a drain opening in a tile floor, wherein the disk is positioned between the floor pan and the mortar which is laid over the floor pan. The drainage disk comprises a disk-shaped piece of relatively thin sheet material. A central opening is provided in the disk-shaped piece, and a plurality of elongate valleys are formed in the disk-shaped piece. The valleys in the disk-shaped piece have inner and outer ends, with the valleys extending radially outwardly from the central opening in the disk-shaped piece.

In use, the workman simply lays the pan on the subfloor and seals the pan to the drain receptor. The drainage disk of the present invention is then placed around the drain receptor so as to cover the weep holes in the drain receptor and overlie the junction of the drain receptor and the pan. Mortar is then laid on the pan.

Additional objects and features of the invention will become apparent from the following detailed description, taken together with the accompanying drawings.

THE DRAWINGS

Preferred embodiments of the present invention representing the best mode presently contemplated of carrying out the invention are illustrated in the accompanying drawings in which:

FIG. 1 is a pictorial view of a drainage disk in accordance with the present invention for use in installing a drain in a tile floor; and FIG. 2 is a cross section through a floor drain assembly using the drainage disk of the present invention.

DETAILED DESCRIPTION OF THE ILLUSTRATED EMBODIMENTS

Figure 1:
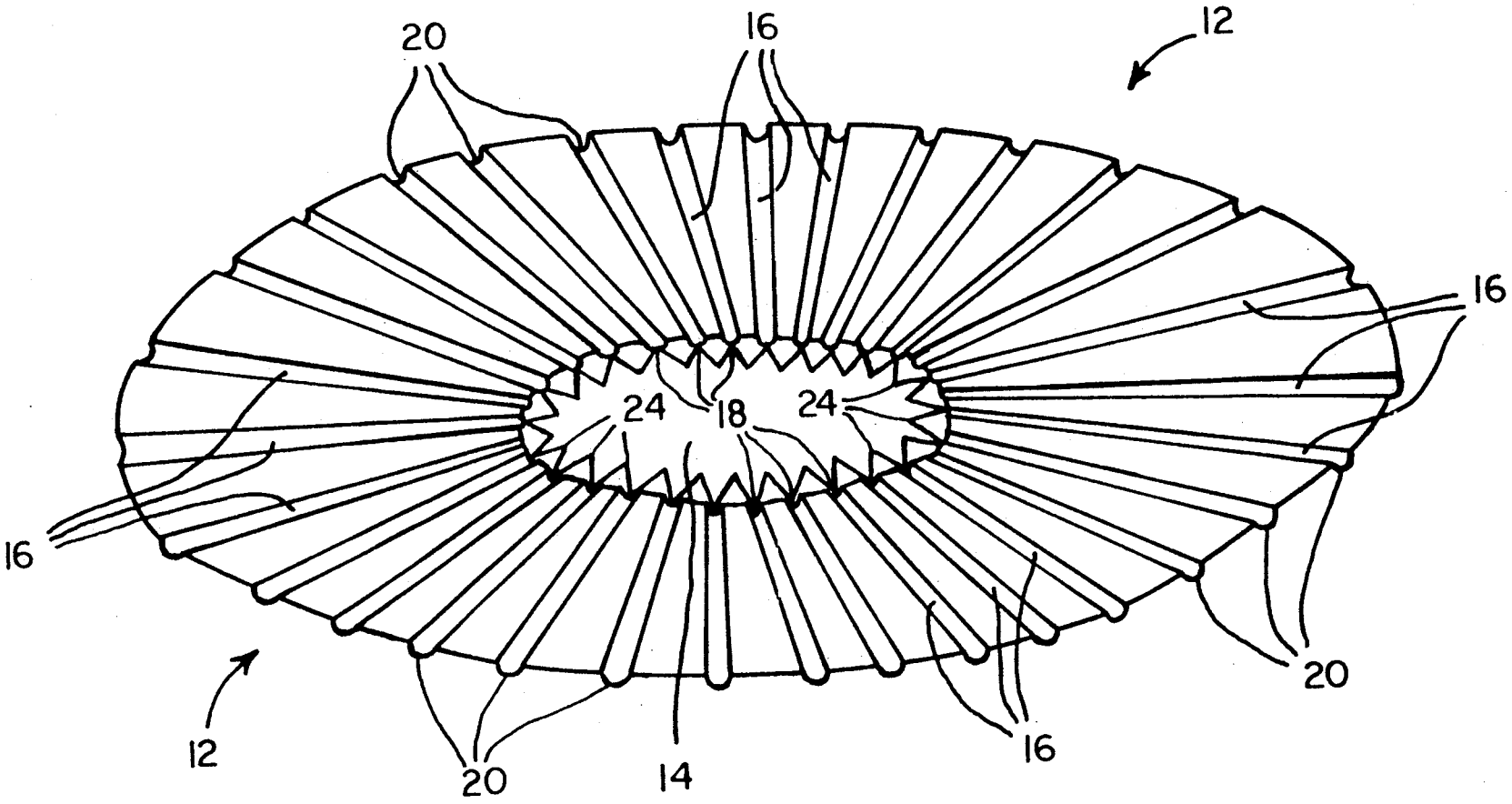
Figure 2:
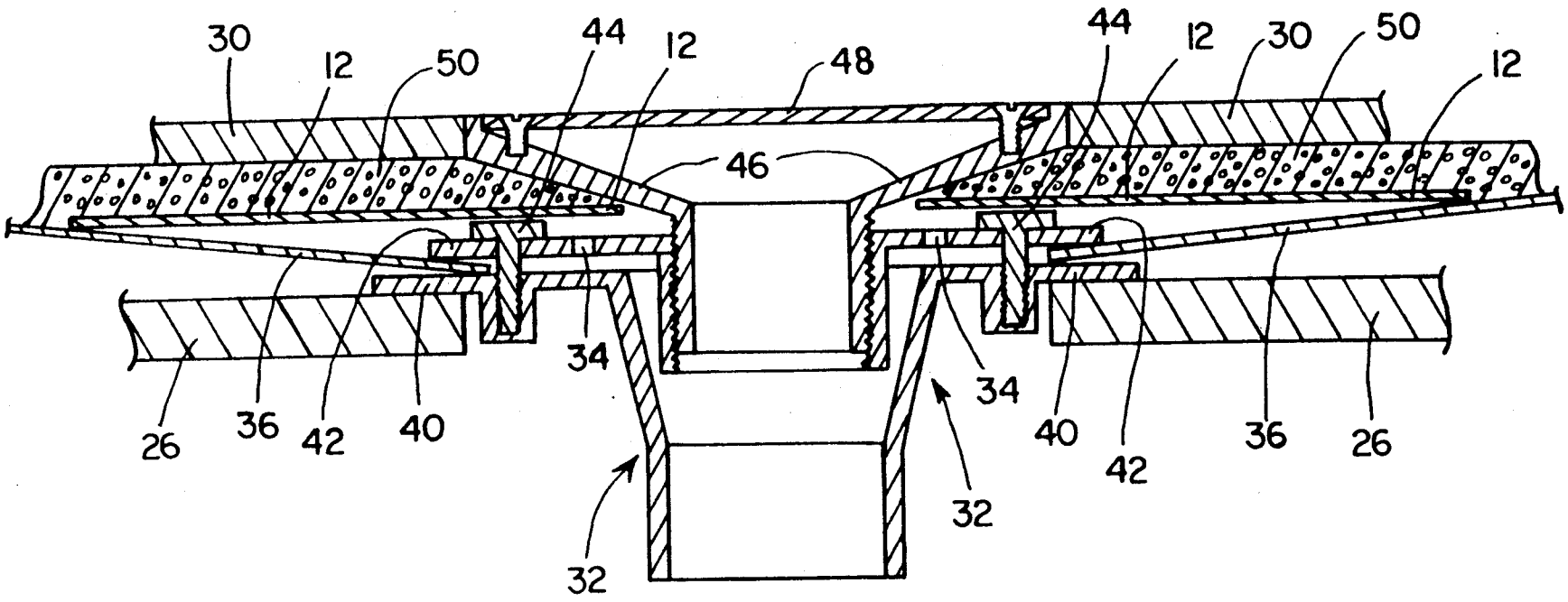

A preferred embodiment of a drainage disk and a floor drain assembly incorporating the drainage disk in accordance with the present invention are shown in FIGS. 1 and 2. The novel and unique drainage disk is shown in FIG. 1 and is adapted for placement between the floor pan and the tile which is laid over the floor pan as specifically shown in FIG. 2.

The drainage disk 12 comprises a disk-shaped piece of relatively thin sheet material. The sheet material is preferably a sheet of polymeric material but could also be made of sheet metal. A central opening 14 is provided in the disk 12, and a plurality of elongate valleys 16 are formed or depressed in the disk 12. The valleys 16 have inner and outer ends 18 and 20, respectively. The valleys 16 are preferably formed in the disk 12 so as to be depressed downwardly from the upper surface of the sheet of material and extend radially outwardly from the central opening in the disk 12.

Advantageously, the inner ends 18 of said valleys 16 are closely spaced to each other so as to create continuous valleys and peaks about the periphery of the central opening 14 in the disk 12. In addition, a plurality of sharp pointed projections 24 preferably extend inwardly a uniform distance toward the center of the opening 14 from the inner ends 18 of the valleys 16 to form a serrated periphery for the central opening 14 in said disk 12. The projections 24 are substantially triangular shaped to simulate equilateral triangles whose base lies adjacent to the periphery of the opening 14 in the disk 12. The triangular-shaped projections 24 are preferably spaced adjacent each other such that bases of adjacent projections 24 are contiguous.

The operation and use of the drainage disk of the present invention will be described with reference to the drain construction for a tiled floor as illustrated in FIG. 2. The drain construction comprises a subfloor 26 on which the tile 30 is to be laid. An opening in which the drain will be installed is cut in the subfloor 26. A drain receptor 32 is placed in the opening in the subfloor 26, with the drain receptor 32 having an opening in alignment with the opening in the subfloor 26. A flange portion of the receptor 32 extends over a portion of the subfloor 26 adjacent to the periphery of the opening in the subfloor 26. The drain receptor 32 has weep channels 34 in the flange portion which communicate with the opening in the drain receptor 32.

A pan 36 is placed on the subfloor and has an opening in alignment with the opening in the drain receptor 32. The pan 36 is sealed water tight to the drain receptor 32. As shown in FIG. 2, the flange portion of the receptor 32 comprises a lower flange member 40 and an upper flange member 42. These two members are connected together by bolts 44, with the bolts 44 being adapted to pull the upper flange member 42 down upon the lower flange member 40. The peripheral edge of the opening in the pan 36 is held tightly between the upper and lower flange members 40 and 42. The weep channels 34 as shown in the drain receptor 32 of FIG. 2 are formed in the upper flange member 42. It is conventional in the trade to also form weep channels which extend radially outwardly in the flange portion of the drain receptor from the opening in the drain receptor. Although not shown in the drawings, these additional weep channels are generally formed as elongate channels cut in the flange portion of the receptor. Such weep channels are well known in the art and need not be further described herein.

A drain member 46 is attached to the drain receptor 32 as is well known in the art, with a drain cover 48 exposed from the floor. In accordance with the present invention, a drainage disk 12, made of relatively thin sheet material and having a central opening therein is positioned such that the central opening in the drainage disk 12 is in alignment with the opening in the drain receptor 32. The disk 12 covers the weep holes in the flange of the drain receptor 32.

The elongate valleys in the drainage disk 12 provide passages for seepage water to flow from the pan 36 to the weep channels 34 in the drain receptor 32. There are a plurality of valleys in the drainage disk 12, and they are not prone to becoming blocked or clogged with extraneous material. The drainage disk 12 is quickly set in place during normal construction of the drain system and provides exceptional protection for the weep channels of the drain receptor 32. Mortar 50 is laid in conventional fashion over the disk 12 and the pan 36, and the finish tile 30 is laid over the mortar.

Although preferred embodiments of the underlay of the present invention have been illustrated and described, it is to be understood that the present disclosure is made by way of example and that various other embodiments are possible without departing from the subject matter coming within the scope of the following claims, which subject matter is regarded as the invention.

I claim:

1. A drainage disk for placement around a drain opening in a floor of the type comprising a mortar layer, wherein the drainage disk is positioned between the floor pan and the mortar which is laid over the floor pan, said drainage disk comprising a disk-shaped piece of relatively thin sheet material;

a central opening in the disk-shaped piece;

a plurality of elongate valleys depressed in said disk-shaped piece, said valleys having inner and outer ends, with the valleys extending radially outwardly from the central opening in said disk-shaped piece; and a plurality of sharp pointed projections extend inwardly a uniform distance toward the center of said opening from the inner ends of said valleys to form a serrated periphery for the central opening in said disk-shaped piece.

2. A drainage disk in accordance with claim 1, wherein the floor is of the type having a tile layer laid over the mortar layer.

3. A drainage disk in accordance with claim 1, wherein the inner ends of said valleys are closely spaced so as to create continuous valleys and peaks about the periphery of the central opening in said disk-shaped piece.

4. Drain construction for a floor of the type comprising a mortar layer, said drain construction comprising a subfloor on which the floor is to be laid;

an opening in said subfloor;

a drain receptor at the opening in the subfloor, said drain receptor having an opening in alignment with the opening in the subfloor and a flange extending over a portion of said subfloor at the periphery of the opening in the subfloor, said drain receptor further having weep channels in said flange which communicate with the opening in said drain receptor;

a pan covering the subfloor and having an opening in alignment with the opening in the drain receptor;

a drainage disk made of relatively thin sheet material and having a central opening therein, said disk being positioned such that the central opening therein is in alignment with the opening in the drain receptor, with said disk covering the weep channels in the flange of said drain receptor;

said drainage disk further having a plurality of elongate valleys depressed therein, said valleys having inner and outer ends, with the valleys extending radially outwardly from the opening in said disk; and mortar laid over the disk and the pan.

5. A drainage disk in accordance with claim 4, wherein tile is laid over the mortar.

6. A drain construction in accordance with claim 4, wherein the inner ends of said valleys are closely spaced so as to create continuous valleys and peaks about the periphery of the central opening in said disk.

7. A drain construction in accordance with claim 4, wherein a plurality of sharp pointed projections extend inwardly a uniform distance toward the center of said opening from the inner ends of said valleys to form a serrated periphery for the central opening in said disk.

* * * * *